US005149084A

United States Patent [19]

Dalebout et al.

[11] Patent Number: 5,149,084

[45] Date of Patent: Sep. 22, 1992

[54] EXERCISE MACHINE WITH MOTIVATIONAL DISPLAY

[75] Inventors: William T. Dalebout; Michael Burk; Kelly Boren, all of Logan, Utah

[73] Assignee: Proform Fitness Products, Inc., Logan, Utah

[21] Appl. No.: 482,188

[22] Filed: Feb. 20, 1990

[51] Int. Cl.[5] ..... A63B 23/035

[52] U.S. Cl. ..... 482/3; 434/247; 73/379; 340/323 R; 273/85 G; 273/440; 273/DIG. 28; 482/9; 482/52; 482/51

[58] Field of Search ..... 272/69, 70, 72, 73, 272/129, 130, DIG. 5; 434/29, 61, 69, 247, 392; 273/1 GE, 1 E, DIG. 28, 85 G, 433, 434, 440, 441, 445, 454; 73/379; 340/323 R

[56] References Cited

U.S. PATENT DOCUMENTS

| | | | |
|---|---|---|---|
| 4,278,095 | 7/1981 | Lapeyre | 272/69 X |
| 4,542,897 | 9/1985 | Melton et al. | 272/132 X |
| 4,625,962 | 12/1986 | Street | 272/132 |
| 4,674,741 | 6/1987 | Pasierb et al. | 272/129 X |
| 4,695,953 | 9/1987 | Blair et al. | 273/85 G X |
| 4,708,337 | 11/1987 | Shyu | 272/69 |
| 4,714,244 | 12/1987 | Kolomayets et al. | 272/72 |
| 4,828,257 | 5/1989 | Dyer et al. | 272/129 |
| 4,832,332 | 5/1989 | Dumbser | 272/72 |
| 4,838,543 | 6/1989 | Armstrong et al. | 272/130 X |
| 4,840,372 | 6/1989 | Oglesby et al. | 272/72 |
| 4,998,725 | 3/1991 | Watterson et al. | 272/129 |

FOREIGN PATENT DOCUMENTS

| | | | |
|---|---|---|---|
| 0159029 | 12/1979 | Japan | 272/70 |
| 8806776 | 9/1988 | World Int. Prop. O. | 272/73 |

*Primary Examiner*—Richard J. Apley
*Assistant Examiner*—Joe H. Cheng
*Attorney, Agent, or Firm*—Trask, Britt & Rossa

[57] ABSTRACT

A stepping exercise apparatus with a motivational display is disclosed. The apparatus has a computer linked with the display and programmed to generate a pair of icons. One icon (the pace icon) represents a fictitious competitor exercising at a target pace, and the other icon (the user icon) represents the user. When the user exercises more slowly or more quickly than the target pace, the user icon moves behind or ahead of the pace icon, respectively. The computer is programmed to accept a user-selected target pace. Thus the user is motivated to improve his performance by competing against the pace icon. The display also contains a progress display indicating to the user his progress toward a target distance.

16 Claims, 13 Drawing Sheets

EXERCISE MACHINE WITH MOTIVATIONAL DISPLAY

BACKGROUND OF THE INVENTION

1. Field

The present invention is directed to an exercise apparatus having a display with icons adapted to motivate a user to achieve a particular performance while exercising.

2. State of the Art

Various stationary exercise machines allow persons to simulate sporting activities such as running, cycling, rowing, etc., while conveniently remaining at home or in a gym. In many sporting environments, persons are motivated to increase their performance by competition with others. For example, when a person runs a foot race, he is motivated to be the first to cross the finish line. Other racing environments, such as boat racing, cycling, cross country skiing, etc. involve similar competition with others with its attendant competitive motivation.

Certain exercise machines have visual displays to provide the user some indication of his performance during an exercise session. For example, some exercise machine displays include a progress indicator to represent to the user a fictional "distance" he has traveled relative to an ultimate target distance. Certain rowing machine displays have an electronically created image or "icon" representing a man posed in a rowing position. As the user rows on the rowing machine, a control system within the exercise machine activates the display to "move" the icon in a rowing motion at a rate corresponding to the actual rate the user is moving the rowing member of the rowing machine.

Currently known exercise machines, however, do not have display systems providing the type of competitive motivation encountered in typical racing environments. Their remains a need for an exercise apparatus having a display including an electronically produced icon representing a fictitious person against which the user competes. The user would be thus motivated to improve his performance.

SUMMARY OF THE INVENTION

The present invention provides a motivational exercise apparatus. A frame is provided for support of other members of the apparatus. A moveable member is associated with the frame and is adapted to repetitiously moved by a user at a rate of movement (the user rate) to thereby exercise on the apparatus. Speed sensing means is associated with the moveable member for sensing the user rate. Computation means is associatively liked with the speed sensing means. Display means is associatively linked with the computation means. The display means has a user icon corresponding to the user rate and a pace icon corresponding to a target rate. The computation means is programmed to receive a preselected target rate, to read the user rate from the speed sensing means, and to activate the display means to visually indicate a comparison between the user rate and the target rate by means of relative corresponding movement of the user icon and the pace icon.

The exercise apparatus may be any type of exercise device allowing for repetitive movement, such as a stepping exerciser, rowing machine, exercise cycle, cross country simulator, etc. The moveable member may be, e.g., stepping pedals, a rowing member, rotating pedals, cross country ski pedals, etc. The speed sensing means may be a magnetic sensor, a mechanical reed switch, or any other device adapted to sense repetitive movement. The computation means may be a computer, microcontroller, state machine, or other device adapted to perform the "programmed" functions.

The icons may represent any figure adapted to provide competitive motivation between a user's actual pace and a target pace. The icons may be generated by any appropriate method, for example, by custom-designed LCD segments being illuminated, images produced on a CRT tube, etc. In a simple form, the icons could be bar graphs or other graphical representation of the comparison between the user rate and the target rate. In a more preferred form, the icons are generated to represent persons posed in an exercising position corresponding to the theme of the exercise device.

Input means may be associatively linked with the computation means for receiving input from a user. The computation means may be programmed to receive the target rate from the input means. The user icon and the target icon may be moveable with respect to each other. The relative movement may be accomplished by leaving one icon in place and moving the other icon or by moving both icons. The computation means may be programmed to activate the display means to visually indicate the rate comparison between the user rate and the target rate in terms of the relative positions of the respective icons. Alternatively, or in combination, the icons may each have moveable parts. The computation means may be programmed to activate the display means to move the movable parts at a rate corresponding to the user rate and the target rate, respectively. In one embodiment the icons each illustrate the motion of a person stepping.

The computation means may be further adapted to receive a target time and a target distance, the target rate, target time and target distance, constituting three target values. The computation means may be programmed to calculate at least one of the target values based upon the other two of the target values.

The computation means may also be advantageously programmed to derive calorie use information based upon the user rate and to display the calorie use information at the display means. The computation means may be programmed to receive a target distance at the input means. The display means may include a position indicator, the computation means being programmed to activate the display means to illustrate the progress or position of a user during an exercise session relative to the target distance.

BRIEF DESCRIPTION OF THE DRAWINGS

In the drawings, which at present represent what is regarded as the best mode of the invention.

DETAILED DESCRIPTION OF THE ILLUSTRATED EMBODIMENT

Figure 1:
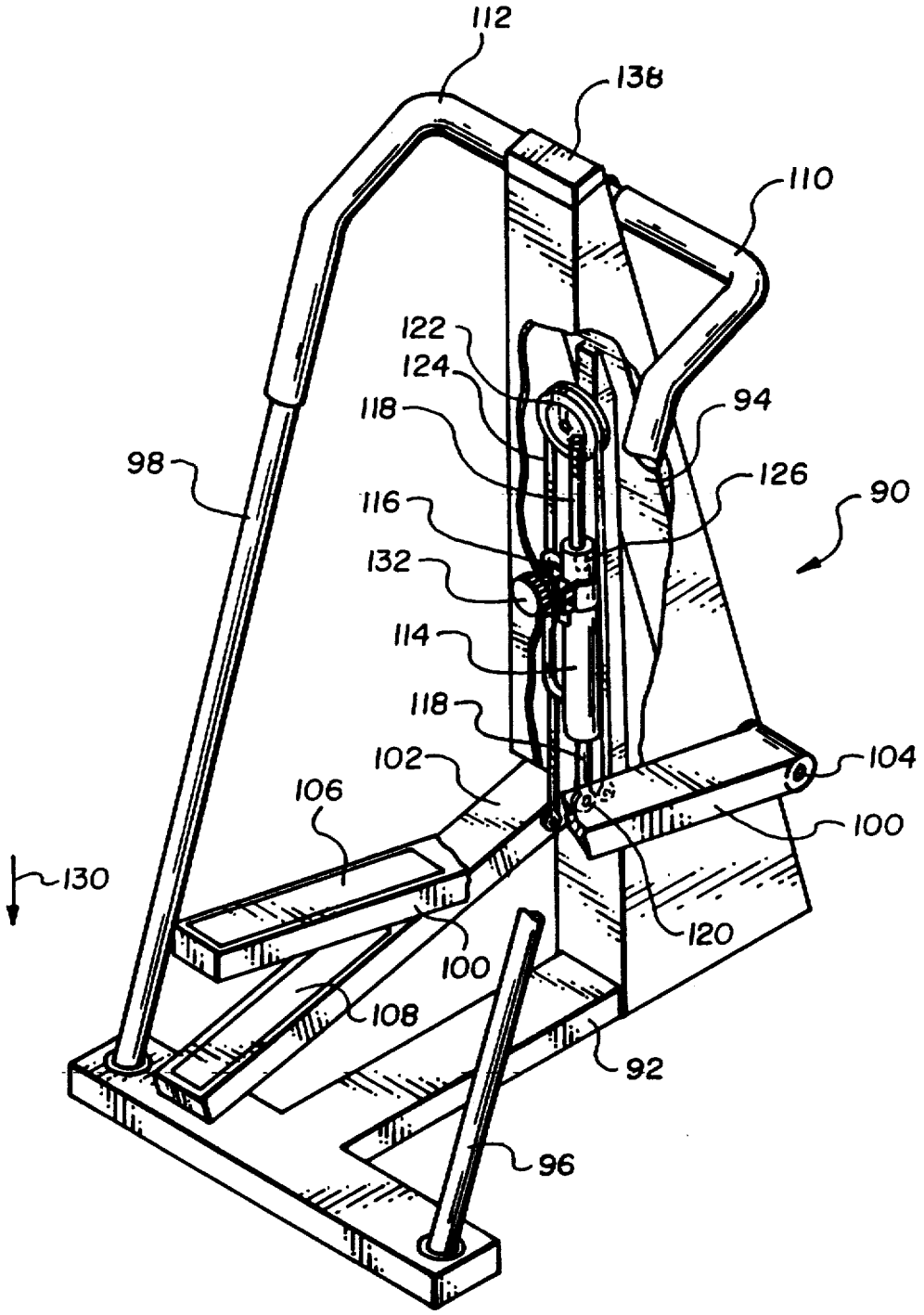
FIG. 1 is a perspective, partial sectional view of a stepping exerciser.

Referring to FIG. 1, a stepping exerciser of the invention includes a frame generally indicated at 90, including a base 92 and an upright frame member 94. A pair of handle bars including a right handle bar 96 and a left handle bar 98 are attached to upright frame member 94 as shown. A pair of pedals, i.e., right pedal 100 and left pedal 102 are pivotally attached to upright frame member 94 by means of pivot shaft 104. Right pedal 100 is shown broken to illustrate components residing behind right pedal 100 as viewed in FIG. 1. An anti-slip grip tape 106 is attached to right pedal 100, and a similar grip-tape 108 is attached to left pedal 102.

A user stands with his right foot on right pedal 100 and his left foot on left pedal 102, specifically on grip tapes 106 and 108 and places his right hand on hand grip 110 and his left hand grasping hand grip 112. The user then alternately steps with his right and left feet to engage in a stepping action similar to the way a person would move while walking up a flight of stairs. The rate of motion of this stepping action and the resistance selected determines the difficulty or work output required while exercising on the apparatus. Right pedal 100 and/or left pedal 102 therefore constitute an illustrated embodiment of a moveable member.

A resistance cylinder 114 is mounted by means of a bracket 116 to upright frame member 94. Resistance cylinder 114 has a piston 118 that is pivotally attached to right pedal 100 at an axle 120. A pulley 122 is rotatably mounted to upright frame member 94 as shown. A cable 124 is attached to right pedal 100, loops around pulley 122 and in turn attaches to left pedal 102 as shown. With this linkage between pedals 100 and 102, cable 124, pulley 122, and cylinder 114, any up and down motions of pedals 100 and 102 is resisted. As pedal 100 is stepped downward in the direction of arrow 130, it pulls piston 118 downward to act against the resistance offered by resistance cylinder 114. Once right pedal 100 reaches its bottom-most position, or against base 92, or at some point prior to this down-most position, the user may step on left pedal 108 to drive it downward. As left pedal 108 is driven downward or in the direction of 130, cable 124 pulls left pedal 100 upward to therefore push piston 118 back into cylinder 114. This motion of piston 118 is also resisted by cylinder 114. Cylinder 114 is adapted to resist the motion of piston 118 equally in either its extending or retracting motions. The user can adjust the amount of resistance offered by turning knob 132.

A magnetic switch 126 is attached to cylinder 114 to sense the motion of piston 118. This magnetic switch is electrically connected to the control system (See FIG. 3) to deliver a signal to the control system corresponding to the rate of motion of the exercise apparatus. A monitor 138 is attached to the top of frame member 94. Monitor 138 contains switches to allow the user to give commands to the control system and a display adapted to motivate the user in his exercise routine.

Figure 2:
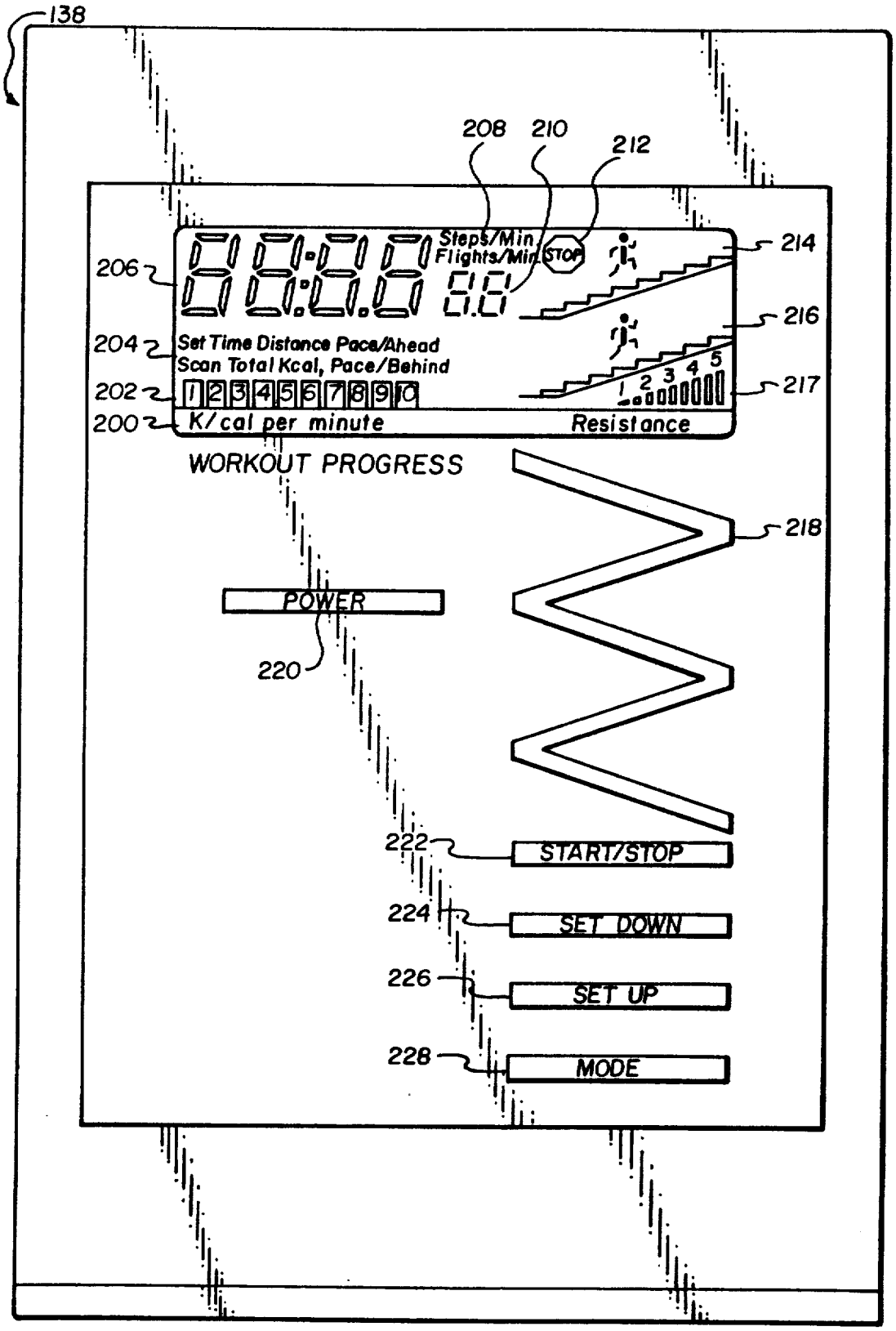
FIG. 2 is a plan view of console 138 of FIG. 1.

Referring to FIG. 2, monitor 138 includes a number of LCD or LED indicators to provide information and to motivate the user. Monitor 138 includes a kilocalories (kcal) per minute legend 200, a numerical kcal per minute display field 202, mode field 204, numerical display field 206, pace field 208, numerical field 210, stop indicator 212, user icon field 216, target rate or pace icon field 214, resistance indicator field 217, and work-out progress field 218. Fields 202–217 are created by various segments being illuminated on a custom designed LCD display. Workout progress field 218 is created by a series of 20 LED's arranged in the zig-zag pattern shown. Console 138 also includes a power key 220, a start/stop key 222, a set/down key 224, a set/up key 226, and a mode key 228.

Field 202 is illuminated in the "on" condition so that an appropriate number in field 202 is illuminated to indicate to the user in whole numbers a calculated value for the kilocalories per minute he is expending on the exercise machine. Field 204 has various segments that are illuminated to indicate to the user which mode he has selected and which is currently being operated. Field 206 displays numerical values for the time, distance, and total kcal modes. Field 208 illuminates either the "steps per minute" or the "flights per minute" indicator. The user may select which of these units his actual pace and the target pace will be expressed in. Field 210 is a display that numerically indicates the pace the user is exercising on the machine in the selected units. Field 212 is a stop indicator that shows whether or not the monitor is started or stopped.

Field 216 electronically presents an icon (the user icon) having the appearance of a man on a staircase and representing the user himself. Field 214 contains a similar icon (the pace icon) representing a fictitious competitor exercising at a target pace that the user has selected in a manner described below. The person depicted in field 216 is generated by six LCD segments being illuminated at one time. The icon in field 216 can be "positioned" upon any one of seven positions. The control system accomplishes this by illuminating an appropriate set of 6 segments on the appropriate level. The "arms" and "legs" of each icon have two positions that may be shown, or two possible segments for each such appendage. By alternately illuminating the available segments for each appendage, the control system causes the person to appear to be stepping. In field 214, the icon remains on the step illustrated. However, the control system repositions the icon in field 216 at an appropriate step to illustrate the user's actual pace relative to a target pace that he has previously selected.

In other words, if the user exercises faster than the target pace, the icon in 216 moves to a higher step than the icon in 214. If the user moves slower than the target pace, the icon in field 216 moves to a step below the step shown for the position of the icon in field 214. The pace at which the user exercises is represented visually by movement of the arms and legs of the icon at a rate corresponding to the rate the user is actually exercising. Similarly, the icon in field 214 has arms and legs with two available segments so it can be made to appear to appear to walk or run at the target pace.

Workout progress indicator 218 contains 20 LED's. The user's "position" or "progress" during an exercise routine is illustrated on this field as compared to a target distance he has previously selected. The control mechanism divides the target distance into 20. As the user progresses towards the target distance the appropriate LED is lit to visually demonstrate to the user's progress. As shown, the LED's in field 218 are arranged in a zig-zagging shape, intended to imply to the user progress up a staircase to correspond to the theme of the stepping exerciser and the stepping icons of fields 214 and 216. If the user has not selected a distance, then one more sequential LED on the stair case 218 illuminates for every four steps.

Figure 3:
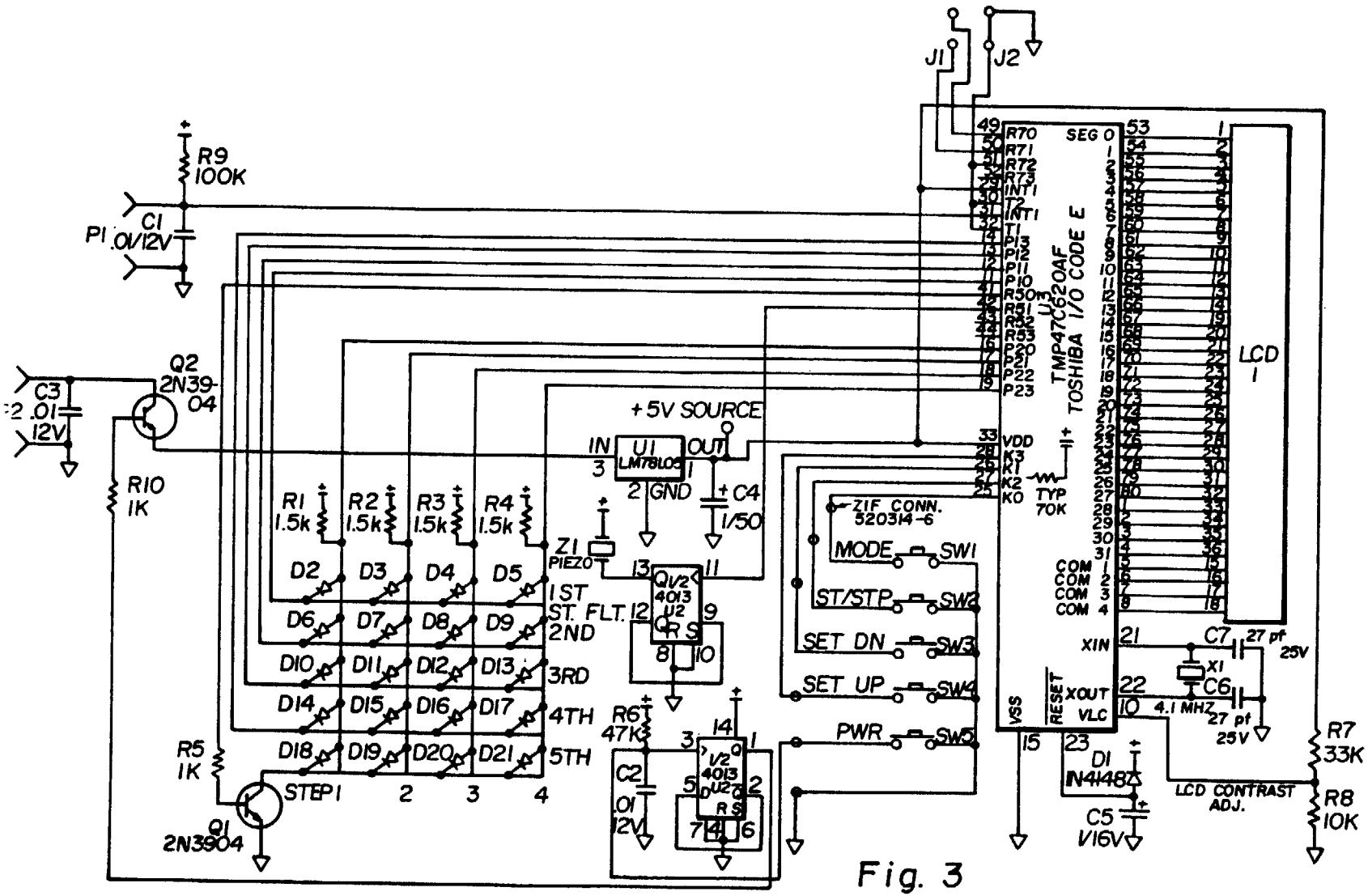
FIG. 3 is a schematic circuit diagram for a control system.

Referring to FIG. 3, U-3 is a micro-controller containing a read-only memory (ROM), a random access memory (RAM), and an LCD driver. U-3 is connected to LCD-1 shown at the right of U-3. LCD-1 is a custom designed LCD display that is designed to display the fields 200 through 217 of FIG. 4. As shown, U-3 contains 32 segment outputs, segments 0 through 31. These 32 segments are quad multi-plexed to allow addressability of a total of 128 LCD segments. U-3 is programmed to illuminate the segments necessary to produce the displays and icons described in reference to FIG. 2.

A set of membrane switches SW1, SW2, SW3, SW4, and SW5 are linked to U-3, as shown. These switches are labeled, respectively, "mode," "start/stop," "set down," "set up," and "PWR." These switches correspond to switches 220 through 228 shown in FIG. 2.

Junction P-2 is connected to the battery that provides the power for the control system. This battery is preferably a 9-volt transistor alkaline battery. U-1 acts as a voltage regulator to output a 5-volt source upon which U-3 operates.

One-half of U-2 is connected to the PWR switch SW5, as shown, and acts as a D-latch. The other half of U-2 is connected as shown to a piezo-electric buzzer Z-1. This half of U-2 acts as an oscillator to provide an oscillating signal to buzzer Z-1. U-3 activates this half of U-2 to cause Z-1 to emit an audible buzz.

A bank of light emitting diodes D-2 through D-21 is connected as shown to U-3. Diodes D-2 through D-21 display the user's "progress" in display field 220. As stated, field 220 contains 20 LED's that may be illuminated one by one to demonstrate progress. As shown, diodes D-2 through D-5 are in a first row, diodes D-6 through D-9 are in a second row and so forth. Each of these rows correspond to one of the five "flights" of the zig-zagging staircase shown in field 220. Thus, each such flight includes four light emitting diodes.

Junction P-1 is connected to the input from the magnetic sensor 126 associated with resistance cylinder 114. U-3 reads the user's actual pace (the user rate), i.e., the rate of movement of pedal 100 and 102, from this input.

The programming or software upon which the control system operates is described in reference to FIGS. 4–13. Program tests or questions are placed in diamond-shaped boxes and program steps are placed in rectangular boxes. In this description, program tests and steps are set forth in parenthesis.

Figure 4:
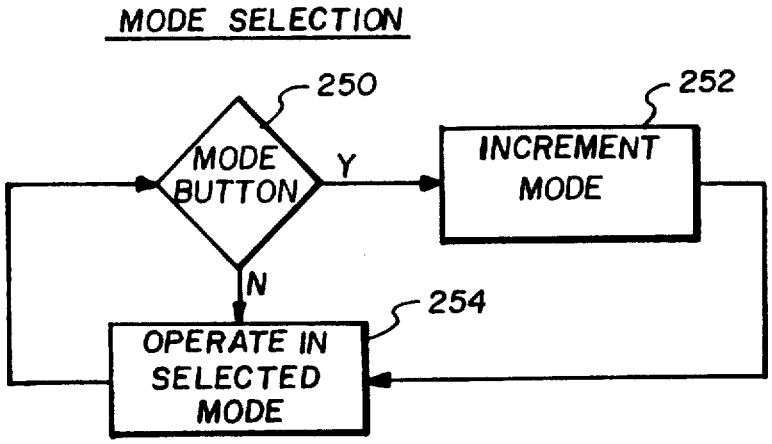
FIG. 4 is a flow diagram of programming to operate the MODE SELECTION.

FIG. 4 depicts a routine by which the user selects the mode in which he desires the control system to operate. The computer first asks if the mode button or mode key 228 is depressed (250). If so, the computer increments to the next mode (252) and then operates in the selected mode (254). If not, the computer operates in the current selected mode (254) and continues to ask whether the mode key has been depressed (250). If no mode is selected, the computer operates in the reset mode, described below.

Figure 5:
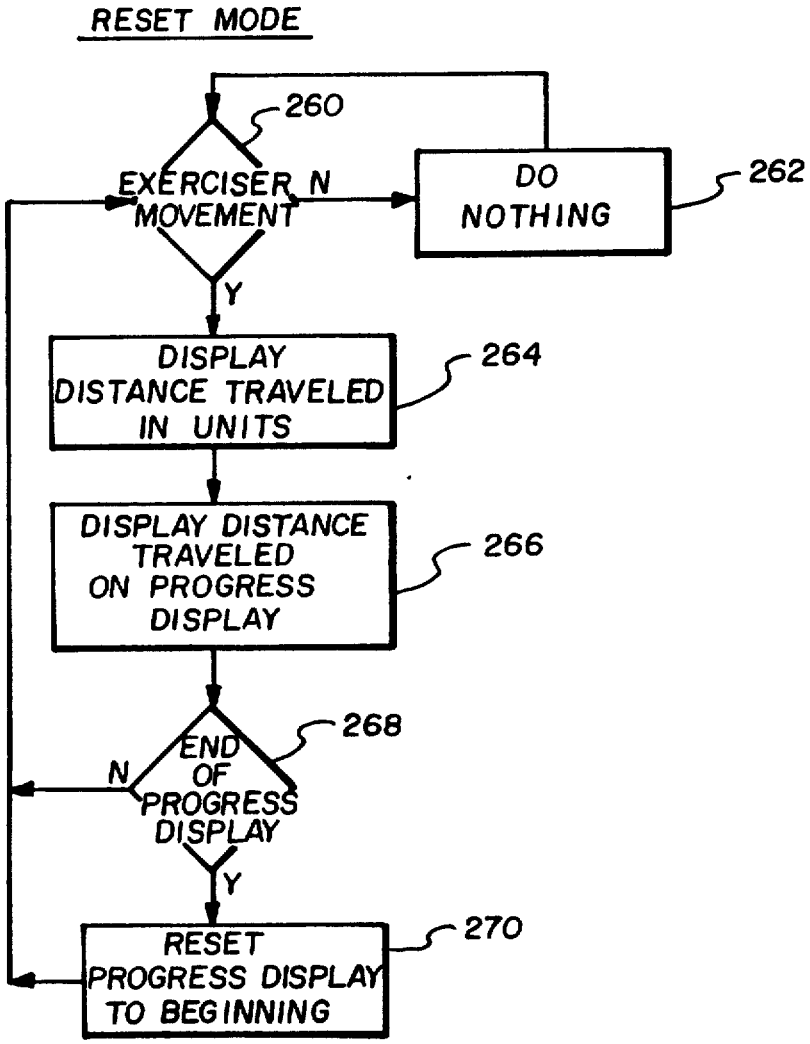
FIG. 5 is a flow diagram of programming to operate the RESET MODE.

FIG. 5 depicts the reset mode. The computer asks whether there is any movement of the exercise machine (260). The computer does this by sensing activity at junction P-1 of electrical responses received from magnetic switch 126. If there is no movement, the computer does nothing (262). If there is movement, the computer displays the distance traveled in whatever units have currently been selected (264). If no change has been made, the distance is displayed in "flights" in field 206. The scale mode for changing the units for distance traveled is described below in reference to FIG. 6. The user's relative distance or progress is displayed in field 220 (266). If the end of the progress display is reached (268), the computer resets the progress display to the beginning (270) and continues to ask whether there is any movement in the exerciser (260). If the end of the progress display is not reached (268), the computer continues to look for movement of the exerciser (260).

Figure 6:
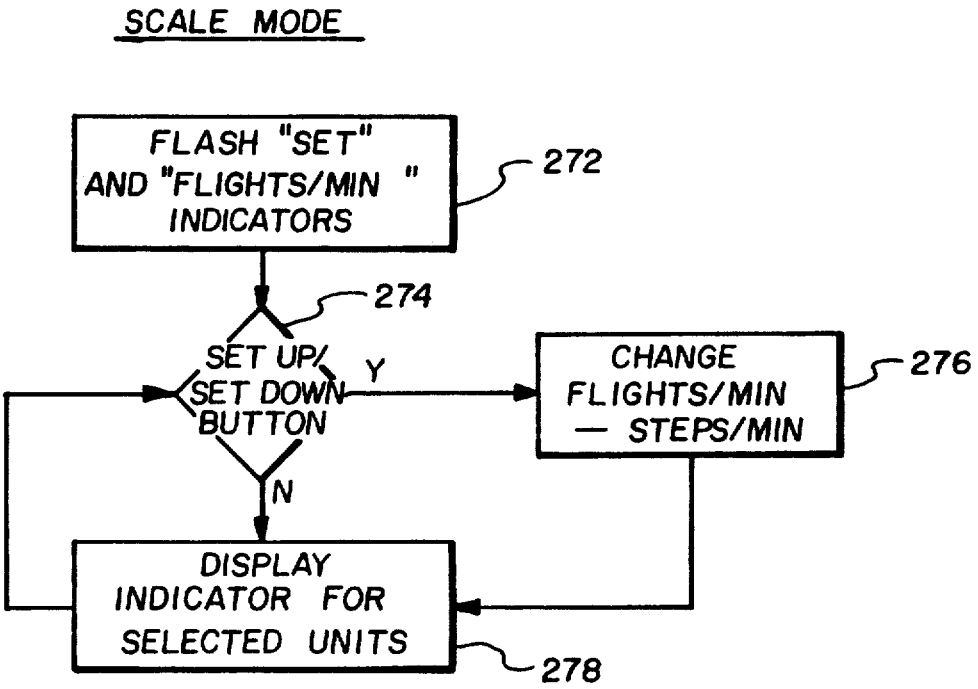
FIG. 6 is a flow diagram of programming to operate the SCALE SET MODE.

The scale mode is described in reference to FIG. 6. The computer flashes the "set" indicator in field 204 and the "flights/min" indicator in field 208 (272). The computer asks whether either the "set up" button 226 or the "set down" button 224 have been depressed (274). If so, the computer changes the units from flights/min to steps/min (276) with appropriate changes to field 208. If there is any movement in the exerciser, the computer calculates and displays the user's pace in the selected units in field 206 (278). If there is again movement of the set up or set down button (274) the computer changes the units to the other unit not currently selected (276) and continues in this fashion allowing for change between the selected units. If the set up or set down button are not depressed (274), the computer continues to calculate and display the user's pace in selected units at field 206 (278).

Figure 7:
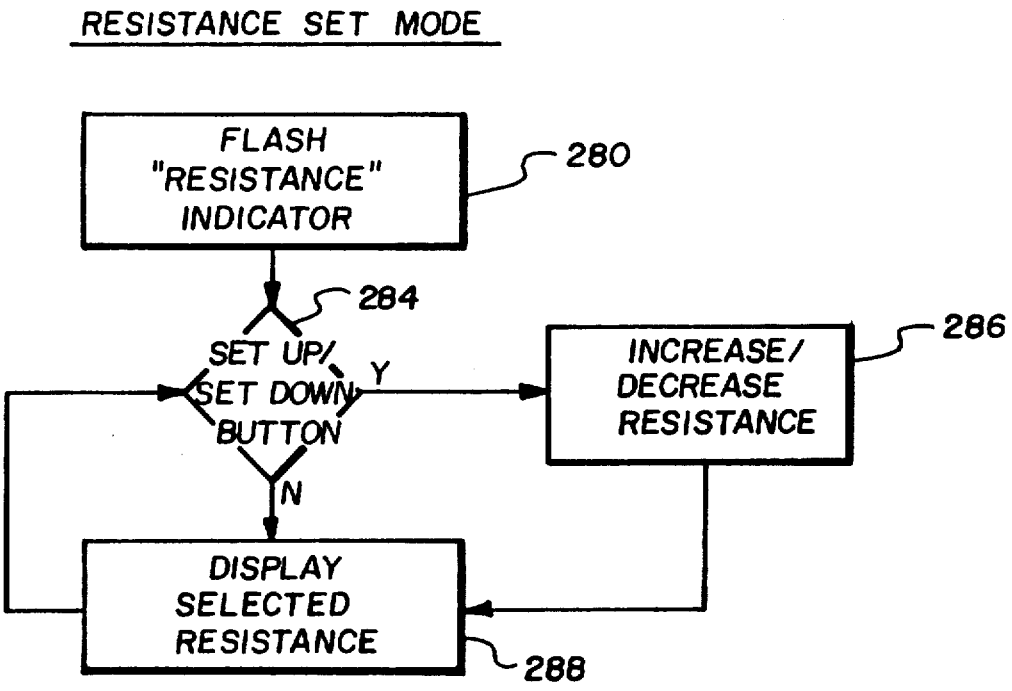
FIG. 7 is a flow diagram of programming to operate the RESISTANCE SET MODE.

FIG. 7 depicts the resistance set mode by which a user of the exercise apparatus programs into the computer a relative resistance level to allow the computer to more accurately calculate kilocalories expended while exercising. The user depresses the mode key until the "resistance" indicator in field 217 flashes (280). At this time, the user is allowed to select a resistance level that he has set by means of adjustment knob 132. The computer asks whether the set up or the set down button have been depressed (284). If so, the computer either increases or decreases the resistance accordingly (286) and displays the selected resistance graphically in field 217 (288). The user is then allowed to continue to increase or decrease the resistance selected (284). The computer accepts five resistance levels, level one being lowest and level five being the highest.

Figure 8:
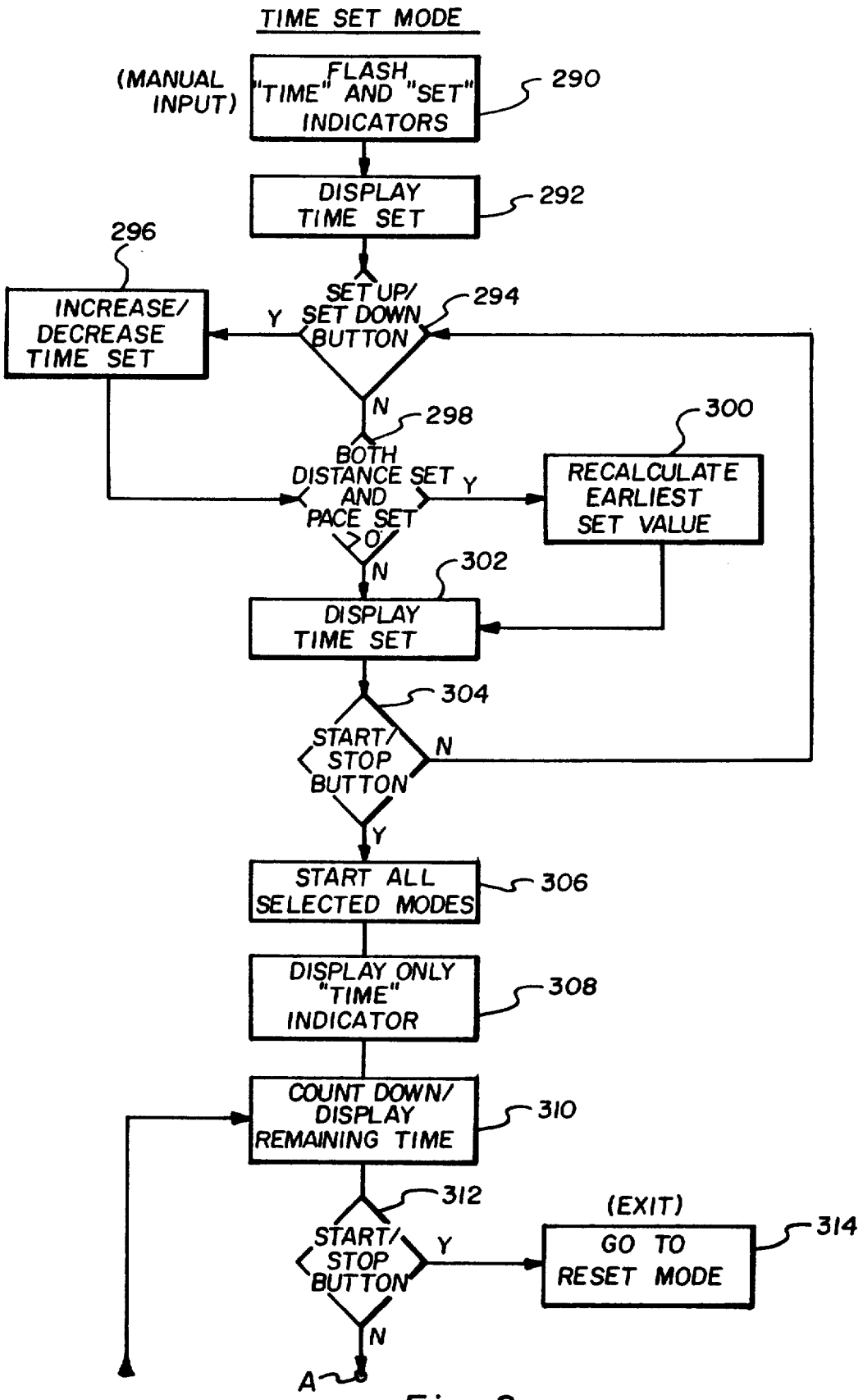
FIG. 8 is a flow diagram of programming to operate the TIME SET MODE. The program for the TIME SET mode is entered via block 290, continues into FIG. 9 at point A, and may be exited via the RESET MODE program at any of blocks 314 in FIG. 8 and 320 or 328 in FIG. 9.
Figure 9:
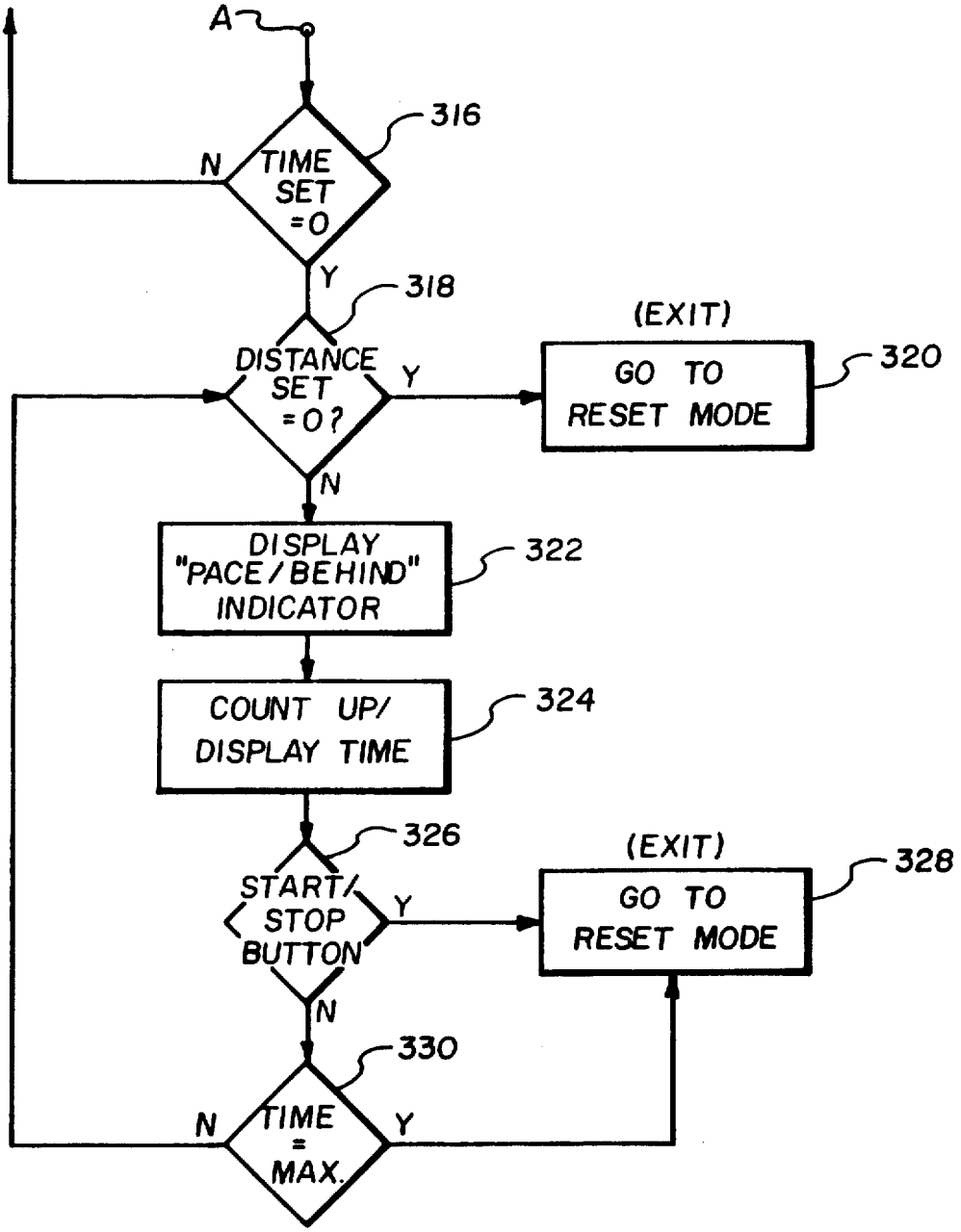
FIG. 9 is a continuation of the flow diagram of FIG. 8 from point A.

FIGS. 8 and 9 depict the time set mode, by which a user selects a target time for which he desires to exercise during a particular exercise session. The user depresses the mode key until the computer flashes the "set" and "time" indicators in field 204 (290). The computer then displays the time set in field 206 (292). If no time has previously been selected, the computer displays a time of zero. The computer then asks if the set up key 226 or the set down key 224 have been depressed (294), if so, the computer increases or decreases the time set accordingly (296).

After the time set has been increased or decreased (296), or if the user does not increase or decrease the time set (294), the computer runs a routine to recalculate either the distance set or pace set (described below) based on the new time set. The distance set, pace set, and time set are three target values that are interrelated by the equation "pace set equals distance set divided by time set". If two of these target values have been previously selected and a new target value is set for a third value, the computer recalculates the earliest of the three target values.

The computer asks whether both the distance set and the pace set are greater than zero (298). In other words, the computer is asking whether these two target values have been previously selected by the user, and if so whether these values continue to be non-zero. If so, the computer recalculates the earliest value of these three target values (300) according to the stated equation. After the earliest set value has been recalculated, or if one of the other two values is zero, the computer displays the time set in field 206 (302). If the start/stop button is not depressed at this time (304), the computer continues to allow the user to set up or set down the time set or target time (294).

If the start/stop button is depressed (304), the computer starts all currently selected modes (306). The computer displays only the "time" indicator (308). In other words, the "set" indicator in field 204 is no longer illuminated. The computer then begins to count down and to display the remaining time in field 206 (310).

If the start/stop button is again depressed (312), the computer goes to the reset mode (314) described above in reference to FIG. 5. If not, and if the time set has not counted down to zero (316) the computer continues to count down and display the remaining time (310). If the time set has counted down to zero (316) and if the distance set has also reached a zero value (318), the computer goes to the reset mode (320) described above in reference to FIG. 5. If the distance set has not reached a zero value (318), the computer displays the "pace/-behind" indicator in field 206 (322). The computer then begins to count up and to display the time elapsed at field 206 (324). In other words, after both the time set has reached a zero value and if the user has not reached his target distance, the computer then begins to tell the user how much time has elapsed since he should have reached the distance within the time he allowed himself.

If the start/stop button is again depressed (326), the computer goes to the reset mode (328). If not, the computer asks itself whether the time in field 206 has reached its maximum value (330), which is 99 minutes and 99 seconds. If this maximum value has been reached, the computer goes to the reset mode (328). If not, the computer continues to ask whether the distance set by the user has reached a zero value (318).

Figure 10:
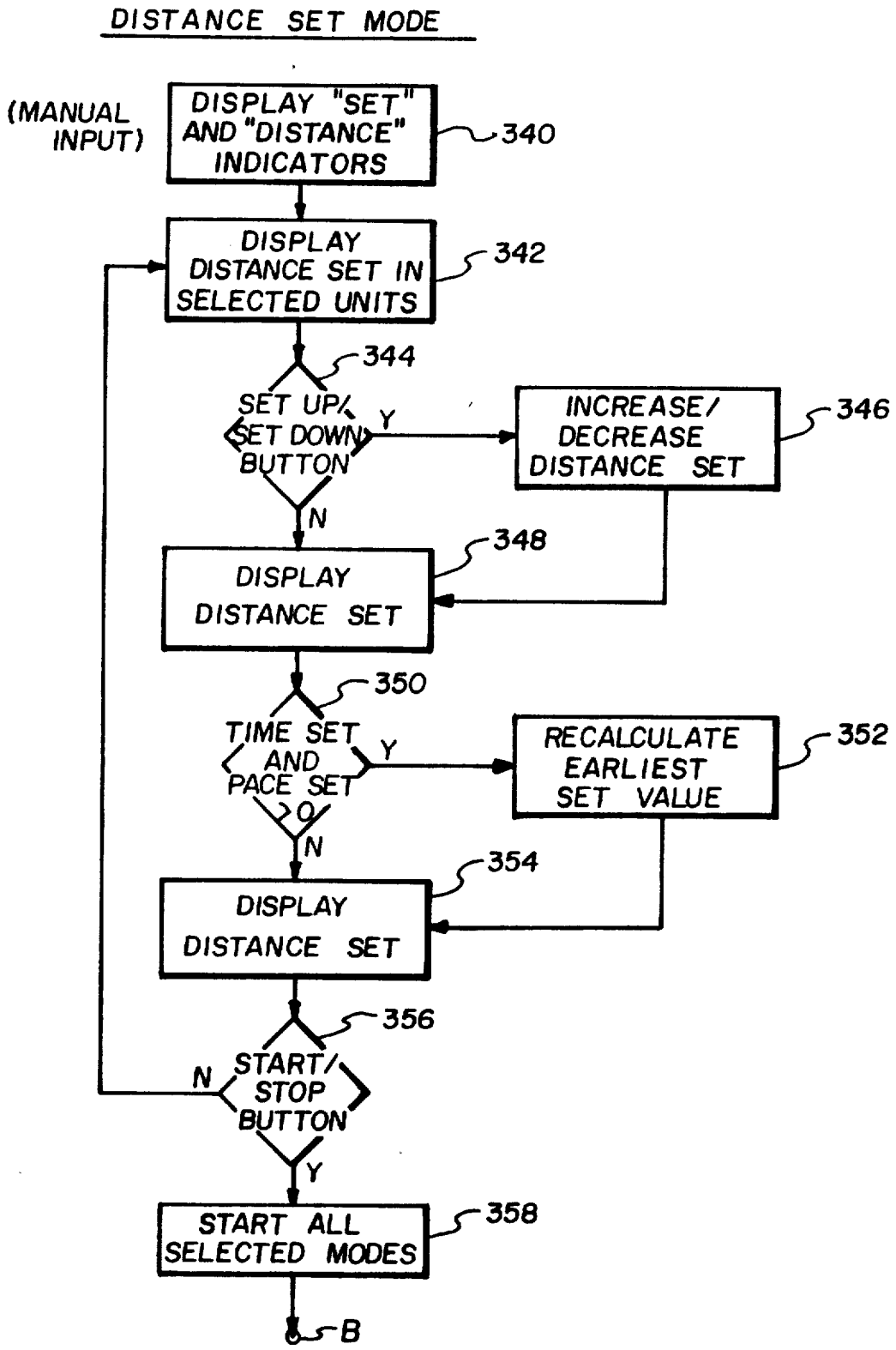
FIG. 10 is a flow diagram of programming to operate the DISTANCE SET MODE. The program for the DISTANCE SET mode is entered via block 340, continues into FIG. 11 at point B, and is exited via either the TIME SET program (block 374) or the RESET MODE program (block 376) in FIG. 11.
Figure 11:
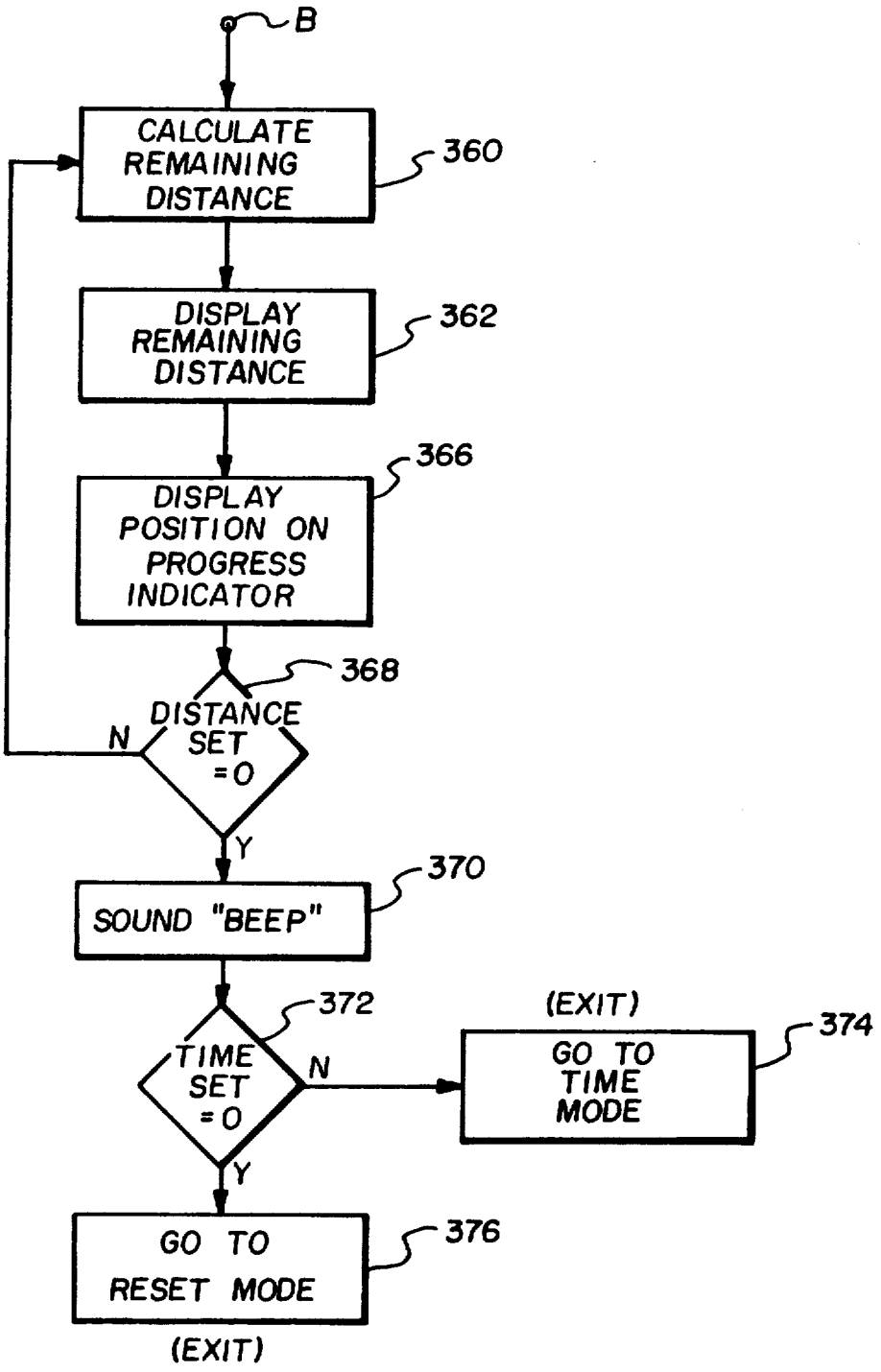
FIG. 11 continues the DISTANCE SET program from point B in FIG. 10.

The distance set mode is described in reference to FIGS. 10 and 11. In this mode, the user selects a target distance which he desires to "travel" during a particular exercise session. Of course, the "distance" is not in an actual physical distance, but is related in some manner to the nature of the exercise device. In the illustrated embodiment, this distance is calculated according to the number of times the user pedals steps 100 and 102 up and down. This distance may be in either steps or flights. A flight equals 16 steps.

The user depresses the mode key until the computer flashes the "set" and "distance" indicators in field 204 (340) and displays the distance set in the selected units in field 206 (342). If the units have not been previously changed in the scale mode, described above in reference to FIG. 3, the units are in flights per minute. If the set up or set down button is depressed (344), the computer either increases or decreases the distance set accordingly (346) and the computer displays the selected distance set in field 206 (348).

The computer then recalculates the earliest set of the three target values if two of the other target values have previously been set. The computer asks whether the time set and pace set are both greater than zero (350). If so, the computer recalculates the earliest set value (352). If not, no values need to be recalculated. The distance set is displayed in field 206 (354). If the start/stop button (222) is not depressed (356) the computer continues to allow for a change of the distance set and for recalculation of the other target values. If the start/stop button is depressed (356), the computer starts all selected modes (358).

The computer calculates the remaining distance in the distance set (360). If the start/stop button has only recently been depressed, this distance is the distance set. The computer then displays the remaining distance at field 206 (362). The computer also displays the "position" of the user on the progress indicator 220 (366). If the distance the user has set has not gone down to zero, i.e. if the user has not reached his target distance (368), the computer continues to calculate and display the remaining distance (360 and 362). If the distance set does equal zero, i.e., if the user has reached the distance set (368), the computer sounds a beep (370) by means of piezo-electric crystal Z-1. If the time set does not equal zero (372) the computer goes to the time mode (374). If the time equals zero (372), the computer goes to the reset mode (376).

Figure 12:
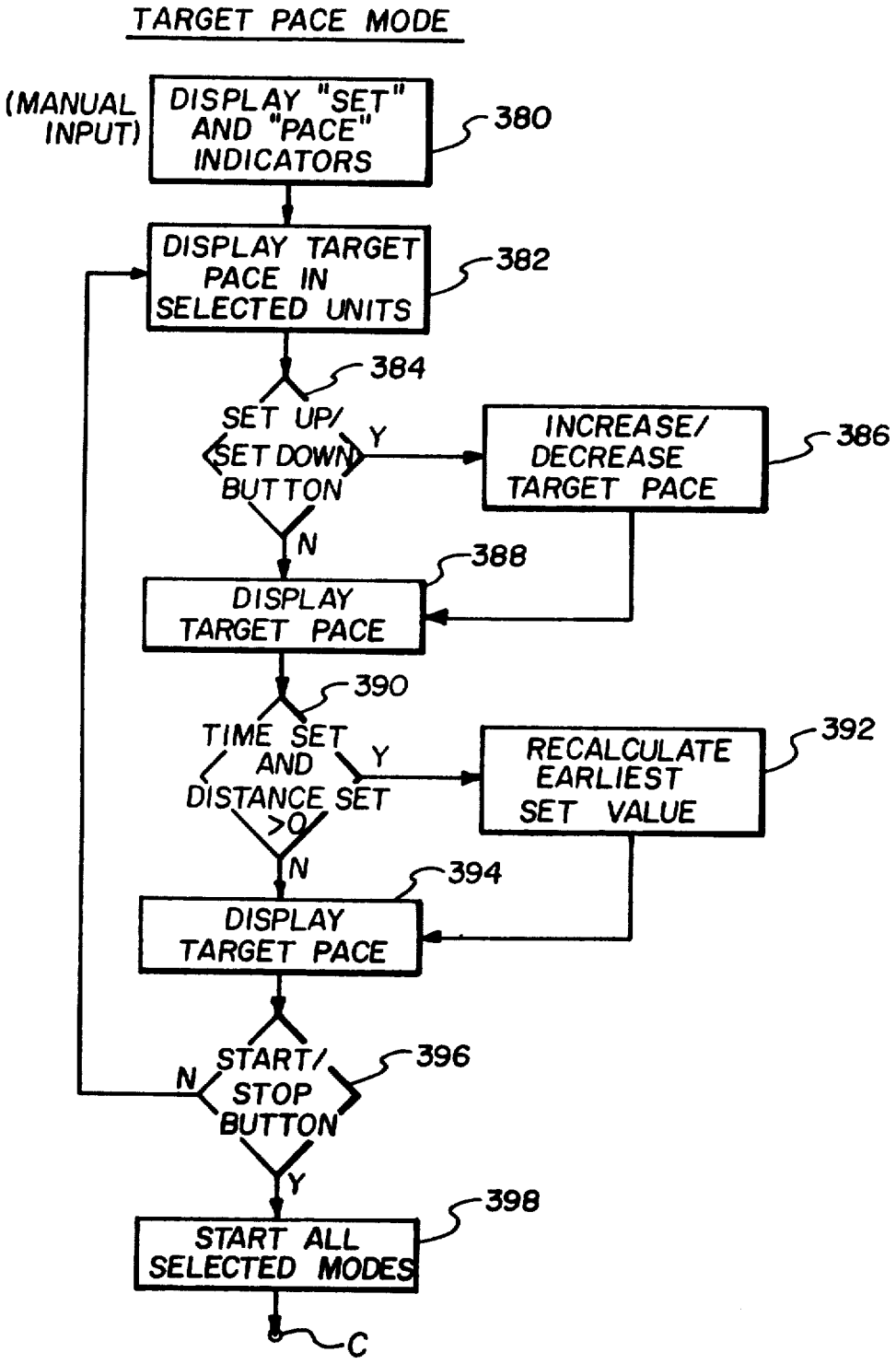
FIG. 12 is a flow diagram of programming to operate the TARGET PACE MODE. The TARGET PACE program is entered via block 380, continues at point C into FIG. 13, and is exited via the RESET MODE program at block 412 in FIG. 13.
Figure 13:
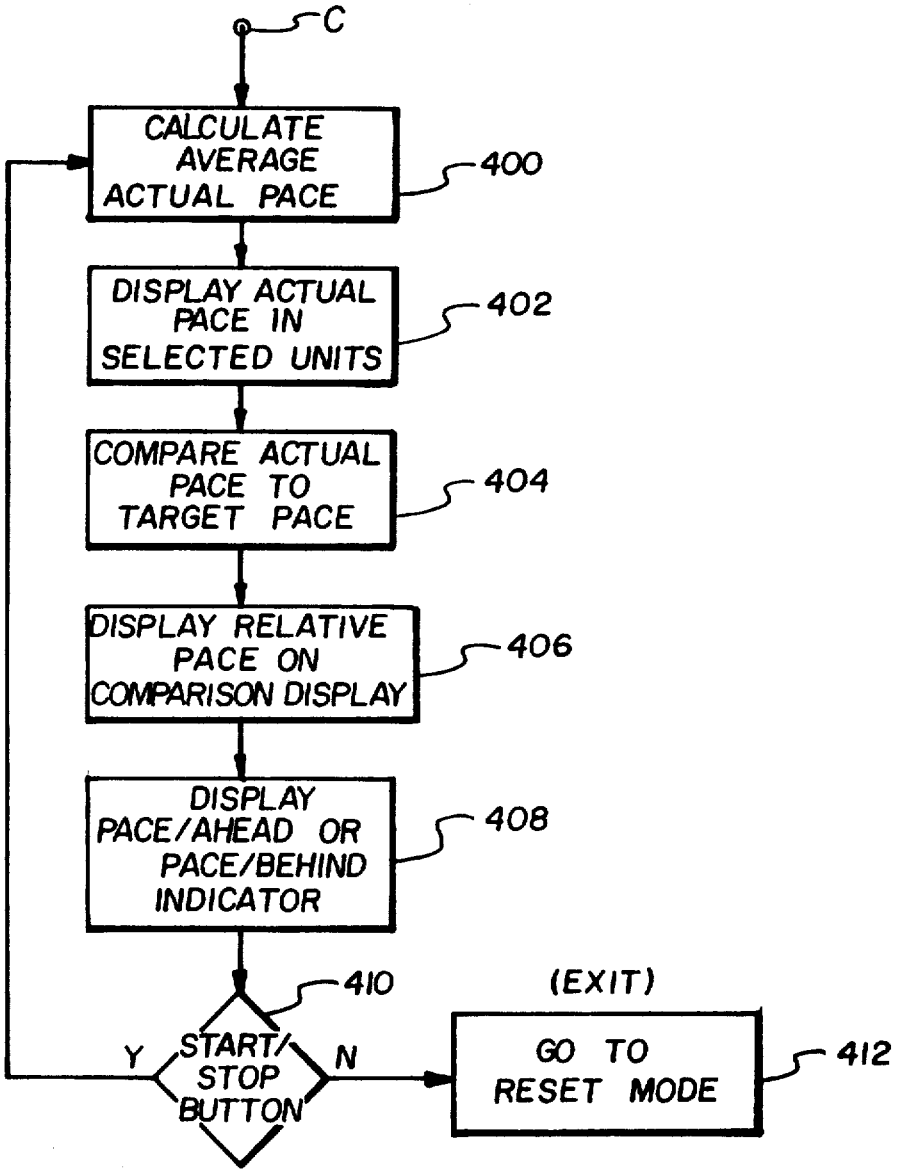
FIG. 13 continues the TARGET PACE mode program from point C in FIG. 12.

The target pace mode is described in reference to FIGS. 12 and 13. In this mode, the user may select a target pace or rate at which he desires to exercise. The control system and console are adapted to provide an icon against which the user may compete. One icon performs at the target pace and another icon represents the user. The user's performance compared to that of the icon represents his own performance compared to his selected target pace value.

The user depresses the mode key until the computer flashes the "set" and "pace" indicators in field 204 (380) and displays the target pace in the selected units in field 206 (382). If the set up or set down buttons are depressed (384) the computer increases or decreases the target pace accordingly (386) and displays the target pace in field 206 (388). If the set up or set down buttons are not depressed (384), the target pace remains the same (388).

If the time set and distance set are both greater than zero (390) the computer recalculates the earliest set value of the three target values (392) according to the prescribed equation and displays the target pace in field 206 (394). If one or more of the time set or distance set values are not greater than zero, none of the other target values are recalculated. If the start/stop button is not depressed (396), the computer continues to display the target pace (382) and to allow for change of this target pace.

If the start/stop button is depressed (396), the computer starts all selected modes (398). The computer calculates the average actual pace based on input at P-1 from magnetic sensor 126 (400) and displays the user's actual pace in the selected units in field 206 (402). The computer then mathematically compares the user's actual pace to the selected target pace (404) and displays the user's actual pace compared to his target pace at fields 214 and 216 (406). If the user is exercising more slowly than his target pace, the icon in field 216 moves the left of the position shown in FIG. 2 to demonstrate that he is behind the icon in field 214. If the user exercises more rapidly than his target pace, the icon in field 216 moves to the right of the position shown in FIG. 2 to demonstrate that he is ahead of the icon in field 216. The relative amount the user exercises either slower or faster than his target pace determines the distance to the left or to the right respectively, the icon in field 216 moves relative to the icon in field 214. If the user is exercising slower or faster than his target pace, the computer will display the "pace/behind" or "pace/ahead" indicator in field 204 (408).

If the distance set is not equal to zero (410) when the time is zero then the computer causes the pace/behind to illuminate. If the distance set is equal to zero and if the time set is not equal to zero (414), the computer indicates pace/ahead and continues to count. When the distance set equals zero (410) and the time set equals zero (414), the computer goes to the reset mode (412).

Figure 14:
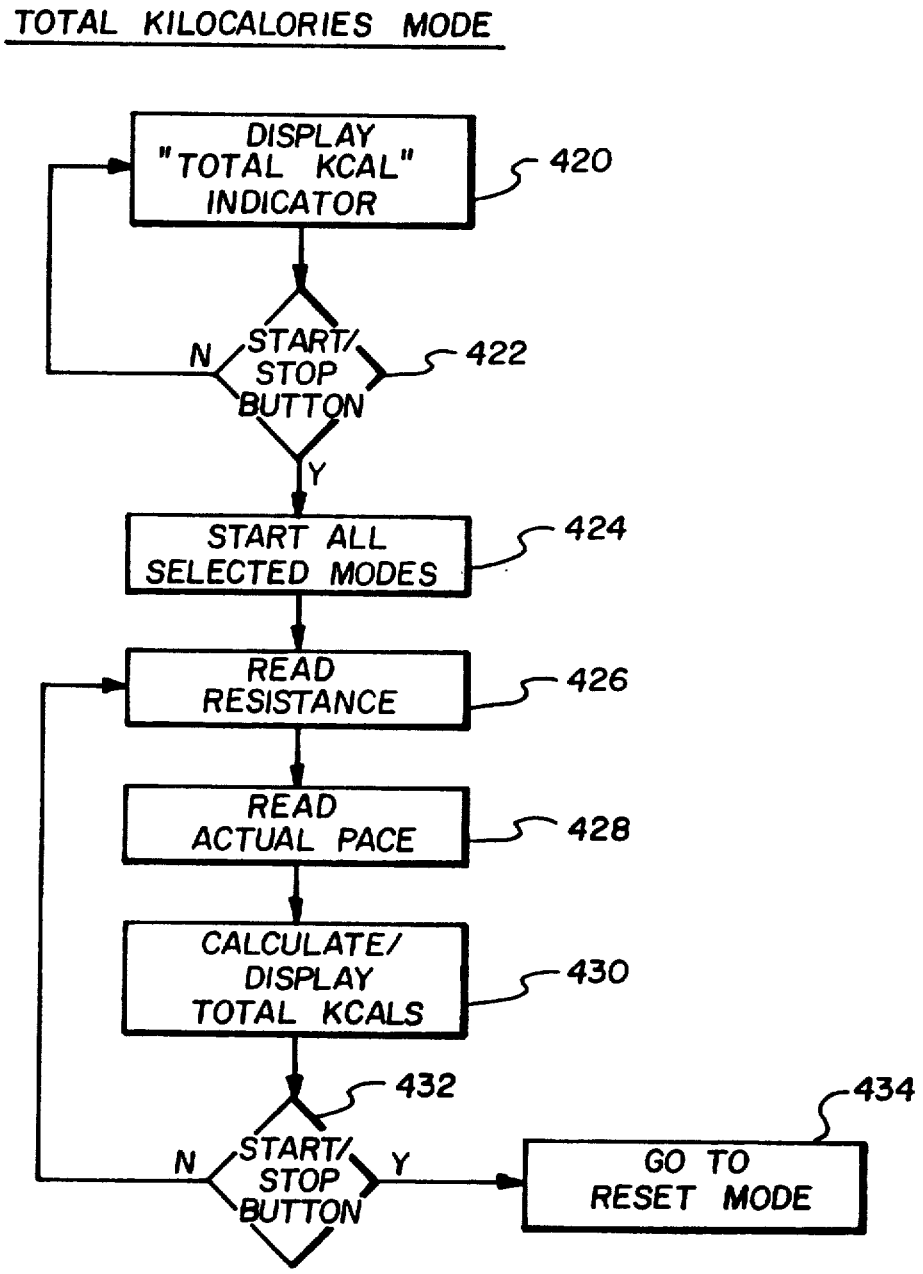
FIG. 14 is a flow diagram of programming to operate the TOTAL KILOCALORIES MODE.

The total kilocalories mode is described in reference to FIG. 14. In this mode the computer is programmed to display to the user the value for the total kilocalories he has expended during a particular exercise session. A calculation of this expenditure of energy is determined by the rate at which the user has exercised on the apparatus, the time for which he has exercised, the nature of the exercise apparatus, and the resistance offered to the user while exercising.

The user depresses the mode key until the computer displays the "total kcal" indicator in field 204 (420). If the start/stop is not depressed (422), the computer continues to display the "total kcal" indicator. If the start/stop button is depressed (422), the computer starts all currently selected modes (424).

The computer then reads the resistance selected by the user during the resistance set mode (See FIG. 7), which resistance is displayed in field 218 (426). The computer then also reads the actual pace the user is exercising on the exercise apparatus based on input from and displays at field 206 the total kilocalories the user has expended during that particular exercise session (430). The computer makes this calculation based on an empirical equation derived for the particular exercise apparatus. The variables in this equation include the resistance set by the user during the resistance set mode, the average pace he is exercising on the exercise apparatus and the time period for which he has exercised. This empirical equation is derived by measuring oxygen use for various persons while exercising on the apparatus at various speeds and at various resistances. Oxygen use is related to the energy a person uses while exercising.

If the start/stop button is again depressed (432), the computer will go to the reset mode (434). If the start/stop button is not depressed, the computer will continue to read the resistance, the actual pace, and to calculate and display the total kilocalories burned by the user.

Figure 15:
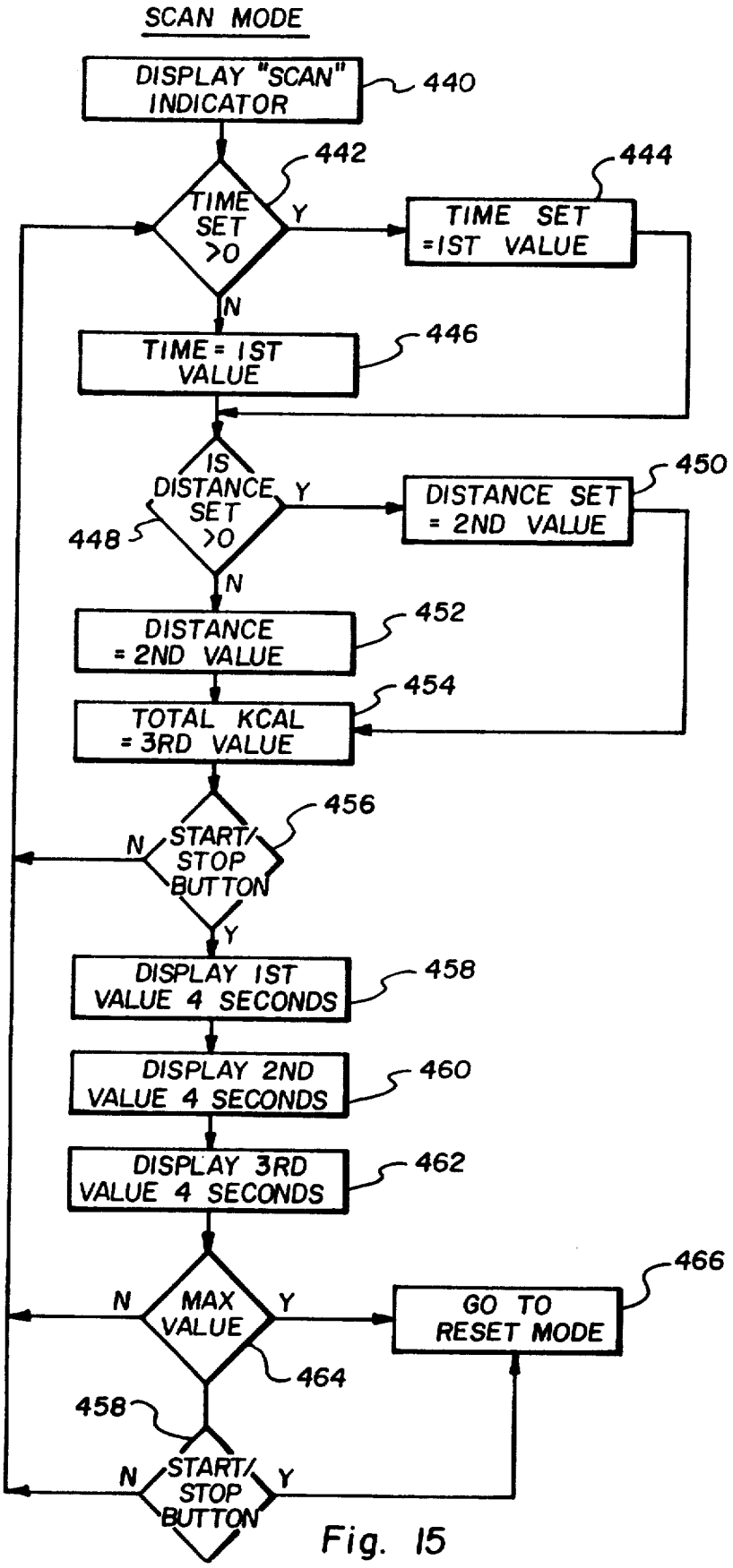
FIG. 15 is a flow diagram of programming to operate the SCAN MODE.

The scan mode is described in reference to FIG. 15. In this mode, the computer scans between various modes, to allow various values and performances to be depicted to the user for a brief period of time. The user depresses the mode key until the computer displays the "scan" indicator in field 204 (440). If the time set is greater than zero (442), the time set, counted backwards, is a first value to be displayed (444). If the time set is not greater than zero (442), i.e. if the time set is equal to zero, the actual time counted from zero and going forward in time is the first value (446).

If the distance set is greater than zero (448), the distance set equals the second value to be displayed (450). If the distance set is not greater than zero (448), i.e. if the distance set is equal to zero, the distance "traveled" by the user is the second value (452). The total kilocalories burned by the user is the third value to be displayed (454).

If the start/stop button is not depressed, the computer continues to ask whether the time set is greater than zero (442) and whether the distance set is greater than zero (448). If the start/stop is depressed (456), the computer displays the first value for four seconds (458), the second value for four seconds (460), and the third value for four seconds (462). These values are displayed in field 206. The indicators in field 204 are illuminated appropriately to indicate to the user what values he is reading numerically in field 206 during each four second interval. The remainder of monitor 138 functions in the same manner described as usual for the particular modes selected.

If the maximum value is achieved for either the distance or time in field 206 (464), the computer goes to the reset mode (466). If the maximum value is not reached (464), the computer continues to loop through the scan mode as described.

In use, a user first depresses a power key 220 to turn the power on. To set a time goal, the user first presses the mode key 228 until the "set" and "time" indicators begin flashing in field 204. The user then presses the set up key 226 to enter a time goal. This goal will appear numerically in field 206 and will change in increments of 1 minute as the set up key 226 is pressed. If the user passes the intended number, he may press the set down key 224 to lower the number.

The monitor can measure distance in either steps per minute or flights per minute. The steps per minute scale will display the user's pace up to 99 steps per minute. If the user exercises at a pace of more than 99 steps per minute the flights per minute scale should be used. The user presses the mode key 228 until the "set" indicator flashes in field 204 and the "flights/min" indicator flashes in field 208. To change the scale the user needs merely press either the set up key 226 or the set down key 224 until the "steps/min" indicator flashes in field 208. The scale can be changed back to flights per minute in the same manner.

To set a distance goal, the user first presses the mode key 228 until the "set" and "distance" indicators in field 204 flash. The user can then press the set up key 226 to display the distance numerically at field 206. If the user passes the intended number, he may press the set down key 224 to lower the number.

To set a pace goal, the user first presses the mode key 228 until the "set" and "pace" indicators flash in field 204. The user then presses the set up key 226 to set his goal. This goal will appear numerically in field 206 in increments of one step or 0.1 flights per minute as the key is pressed. If the user passes the intended number, he may press the set down key 224 to lower the number.

As either the time, distance, or pace goals are set, the other two values have been previously set, the earliest set value will be recalculated automatically according to the equation "pace equals distance divided by time."

For the kilocalories per minute mode to be most accurate, the resistance setting of the stepper must be entered into the monitor. The user presses the mode key until the "resistance" indicator in field 218 flashes. The user then presses the set up key 226 or set down key 224 to enter the resistance level that he has set at knob 132. If the stepper is set at low resistance, the resistance indicator should be at levels 1 or 2. If the stepper is set at medium resistance, the indicator should be at level 3. If the stepper is set at high resistance, the indicator should be at levels 4 or 5.

After the time, pace, and distance goals have been set as described above, the user need merely begin stepping on the exerciser to start the work out. The monitor will display the following information: Field 210 will display numerically the pace goal the user has set. The icon in field 214 will appear to step in place in its position on the stair case as shown in FIG. 2. The icon in field 214 steps at a pace corresponding to the pace goal. The icon in field 216 will also appear to be stepping, however, at a pace corresponding to user's actual pace on the stepper. In contrast to the icon of field 214, the icon of field 216 may appear to change in its position on the staircase as the user exercises. If the user is stepping faster or slower than the goal pace, the icon in field 216 will move ahead of or behind the icon in field 214. For the user to achieve his pace goal he should keep the icon in field 216 even with the pace icon in field 214.

The work out progress display in field 218 is also activated, displaying the user's progress towards his distance goal. This display consists of 20 individual LED's, each representing 1/20th of the goal. As the user begins stepping, the first LCD is illuminated. After the user steps 1/20th of the distance goal, the second LCD is illuminated, and so on, until the final LCD is illuminated. Only one LCD is illuminated at a time. The number of kilocalories that the user is expending per minute is also shown in the kilocalorie per minute display in field 202.

The user may select the total kilocalories mode by pressing the mode key until the "total kcal" indicator is illuminated. The total number of kilocalories the user has expended will be shown in field 206. The user may select the scan mode by depressing the mode key until the "scan" indicator is lit in field 204. The time set, distance set, and total kilocalories modes are then displayed in a repeating cycle in field 206, with each mode being displayed for four seconds.

When the distance goal is reached, a tone will sound and the work out is then completed. If the computer is in the scan mode, the monitor will continue to scan. If the time goal has not yet been reached, the time remaining will be displayed and the "pace/ahead" indicator in field 204 will be lit. If the time goal has been reached, the time since completion of the goal will be displayed and the "pace/behind" indicator will be lit.

Reference herein to details of the illustrated embodiment is not intended to limit the scope of the appended claims, which themselves recite those features regarded important to the invention.

We claim:

1. An exercise apparatus, comprising:

a frame;

a movable member associated with said frame, said moveable member being positioned and configured to be repetitiously moved by a user at a user rate of movement selected by said user;

speed sensing means associated with said moveable member for sensing said user rate;

input means associatively liked with a computation means and operable by said user to input target values of exercise parameters, said target values including a target user rate, target distance and target time;

said computation means associatively linked with said speed sensing means for computing exercise parameters, said computation means being operable to receive said target values from said input means and said user rate from said speed sensing means, and to calculate one of said target values from any two of said target values; and display means associatively linked with said computation means for displaying said target values.

2. An exercise apparatus according to claim 1 wherein said display means includes user icons corresponding to said user rate and pace icons corresponding to said target user rate, said user icons and said pace icons being positioned relative to each other, and wherein said computation means is further operable to selectively activate said user icons and said pace icons to visually indicate a comparison between said user rate and said target user rate by the relative position of said user icons and said pace icons.

3. An exercise apparatus according to claim 2 wherein said user icons include a set of first indicators, and said display means is operable to activate and deactivate individual of said first indicators in a sequence and at a rate which represents said user rate, and wherein said pace icons include a set of second indicators, said display means being further operable to activate and deactivate individual of said second indicators in a sequence and at a rate which represents the target user rate.

4. An exercise apparatus according to claim 3 wherein said user icons and said pace icons each depict the motion of a person stepping.

5. An exercise apparatus according to claim 1 wherein said user icons and said pace icons are moveable in position with respect to each other and wherein said computation means is programmed to activate said display means to visually indicate said comparison in terms of the relative positions of said user icons and said pace icons.

6. An exercise apparatus according to claim 1 further including resistance means associated with said moveable member for resisting movement of said moveable member at a selected resistance level, wherein said computation means is further operable to calculate calorie use information based upon said user rate and said selected resistance level and to activate said display means to display said calorie use information.

7. An exercise apparatus according to claim 1 wherein said display means includes an actual distance indicator and said computation means is further operable to compute an actual distance traveled by said user according to said user rate and to activate said actual distance indicator to display said actual distance relative to said target distance.

8. The exercise apparatus according to claim 1 further including means to digitally display said user rate and said target rate.

9. The exercise apparatus of claim 1, wherein said computation means is operable to provide a signal representative of additional time required by said user moving at said user rate to reach said target distance when said user rate is less than said target rate.

10. A stepping exercise apparatus, comprising:

a frame;

a pair of stepping pedals movably mounted to said frame and configured for stepping movement by a user at a user rate of movement selected by the user;

rate sensing means associated with said stepping pedals for sensing said user rate;

input means associatively linked with a computation means and operable by said user to input target values of exercise parameters, said target values including a target movement rate, target distance and target time;

said computation means for computing exercise parameters and associatively linked with said rate sensing means to receive a signal reflective of said user rate and with said input means to receive signals reflective of said target values, and to calculate one of said target values from any two of said target values; and display means associatively linked with said computation means for displaying said target values.

11. A stepping exercise apparatus according to claim 11 wherein said display means includes user icons corresponding to said user rate and pace icons corresponding to said target movement rate, said user icons and said pace icons being positioned relative to each other, and said computation means is further operable to selectively activate said user icons and said pace icons to visually indicate a comparison between said user rate and said target movement rate by the relative position of said user icons and said pace icons.

12. An exercise apparatus according to claim 11 wherein said user icon includes a set of first indicators, and said display means is operable to turn individual of said first indicators on and off in a sequence and at a rate which represents the rate at which said moveable member is repetitively moved by said user, and said pace icon includes a set of second indicators, said display means being further operable to turn individual of said second indicators on and off in a sequence and at a rate which represents the rate at which said moveable member would be moved by a user exercising at said target rate.

13. A stepping exercise apparatus according to claim 12 wherein said user icon and said pace icon each depict the motion of a person stepping.

14. A stepping exercise apparatus according to claim 10, further including resistance means associated with said stepping pedals for applying a variable resistance, wherein said computation means is further operable to calculate calorie use information based upon said user rate and resistance and to activate said display means to display said calorie use information.

15. A stepping exercise apparatus according to claim 10 wherein said display means includes a position indicator, said computation means being further operable to activate said display means to display the position of said user during an exercise session relative to said target distance.

16. A stepping exercise apparatus of claim 10, wherein said computation means is operable, when said target time has elapsed and said target distance has not been reached, to continue operations until said user achieves said target distance, and said display means is further operable to display additional exercise time used by said user until said target distance is reached.

* * * * *

UNITED STATES PATENT AND TRADEMARK OFFICE

CERTIFICATE OF CORRECTION

PATENT NO. : 5,149,084

DATED : 9/22/92

INVENTOR(S) : Dalebout et al.

It is certified that error appears in the above-indentified patent and that said Letters Patent is hereby corrected as shown below:

In Column 1, line 49, after "to" insert --be--;

In Column 1, line 53, change "liked" to --linked--;

In Column 5, line 22, delete "user's" and insert therefor --user his--;

In Column 6, lines 63 and 64, change "button" to --buttons--;

In Column 9, line 19, before "the" (first occurrence) insert --to--;

In Column 12, line 16, change "liked" to --linked--;

In Column 13, line 39, change "11" to --10--;

In Column 14, line 6, delete "an" and insert therefor --A stepping--;

In Column 14, line 7, change "icon includes" to --icons include--;

In Column 14, line 10, after "represents" delete "the" and insert --said user--;

In Column 14, line 10, after "rate" delete "at which said moveable member is repetitively moved by said user,";

In Column 14, line 11, after "and" insert --wherein--;

In Column 14, line 12, change "icon includes" to --icons include--;

UNITED STATES PATENT AND TRADEMARK OFFICE

CERTIFICATE OF CORRECTION

PATENT NO. : 5,149,084

DATED : 9/22/92

INVENTOR(S) : Dalebout et al.

It is certified that error appears in the above-indentified patent and that said Letters Patent is hereby corrected as shown below:

In Column 14, line 13, after "to" delete "turn" and insert therefor --activate and deactivate--;

Column 14, line 15, after "the" insert --target movement--

In Column 14, line 15, after "rate" delete "at which said moveable member would be moved by a user exercising at said target rate".

Signed and Sealed this

Third Day of May, 1994

Bruce Lehman

*Attest:*

BRUCE LEHMAN

*Attesting Officer*

*Commissioner of Patents and Trademarks*